US008366245B2

(12) United States Patent
Guan et al.

(10) Patent No.: US 8,366,245 B2
(45) Date of Patent: Feb. 5, 2013

(54) FIN-SHAPED HEATER STACK AND METHOD FOR FORMATION

(75) Inventors: Yimin Guan, Lexington, KY (US); Burton Lee Joyner, II, Lexington, KY (US); Zachary Justin Reitmeier, Lexington, KY (US); Carl Edmond Sullivan, Stamping Ground, KY (US)

(73) Assignee: Lexmark International, Inc., Lexington, KY (US)

( * ) Notice: Subject to any disclaimer, the term of this patent is extended or adjusted under 35 U.S.C. 154(b) by 920 days.

(21) Appl. No.: 12/344,706

(22) Filed: Dec. 29, 2008

(65) Prior Publication Data

US 2010/0165054 A1 Jul. 1, 2010

(51) Int. Cl.
*B41J 2/05* (2006.01)

(52) U.S. Cl. ..... 347/63; 347/61; 347/62; 347/64

(58) Field of Classification Search ..... 347/61–65; 29/611

See application file for complete search history.

(56) References Cited

U.S. PATENT DOCUMENTS

| | | | | |
|---|---|---|---|---|
| 4,707,708 | A * | 11/1987 | Kitagishi et al. | 347/202 |
| 4,935,752 | A * | 6/1990 | Hawkins | 347/62 |
| 5,142,300 | A * | 8/1992 | Aoki | 347/183 |
| 2005/0174390 | A1 * | 8/2005 | Sun et al. | 347/63 |

* cited by examiner

*Primary Examiner* — Matthew Luu
*Assistant Examiner* — Henok Legesse

(57) ABSTRACT

A fin-shaped heater stack includes first strata configured to support and form fluid heater elements responsive to repetitive electrical activation and deactivation to produce repetitive cycles of ejection of a fluid, and second strata on the first strata to protect the fluid heater elements from adverse effects of the repetitive cycles of fluid ejection and of contact with the fluid. The first strata include a substrate having a front surface, and heater substrata supported on the front surface. The heater substrata have opposite facing side surfaces which extend approximately perpendicular to the front surface and an end surface interconnecting the side surfaces which extends approximately parallel to the front surface such that the heater substrata is provided in either an upright or inverted fin-shaped configuration on the substrate with the fluid heater elements forming the opposite facing side surfaces of the heat substrata.

14 Claims, 4 Drawing Sheets

FIN-SHAPED HEATER STACK AND METHOD FOR FORMATION

CROSS REFERENCES TO RELATED APPLICATIONS

None.

BACKGROUND

1. Field of the Invention

The present invention relates generally to micro-fluid ejection devices and, more particularly, to a fin-shaped heater stack and method for formation.

2. Description of the Related Art

The realization of ultimate inkjet print quality is influenced by several factors, of which one important driving force is the reduction of droplet size and spacing to the minimum detectable limits of the human eye. A desirable goal might be to achieve 1.5 pL drops placed at 1800 dpi. However, given current inks, flow features and nozzle materials, ejector and circuit design, and thin film materials in the heater stack, any printhead that attempts to achieve this goal would be thermally limited due to extreme heat generated on the chip, and specially limited by heater dimension. In order to maintain competitive print speeds, the chip would rapidly rise to >>100° C., eliminating drop-on-demand capability. Conversely, reducing the fire frequency for thermal management would require such a dramatic decrease that the print speed would be extremely slow. On the other hand, in order to maintain adequate drop velocity, certain heater area is required. The solution to this dilemma is to reduce the energy required per heater fire, and remove heater dimension as a limiting factor.

The input energy to an inkjet heater is consumed in several ways. A portion of this energy is transferred to the ink and used beneficially for bubble formation. However, a large portion of the energy is dissipated in the materials over and under the heater. Therefore, by minimizing this waste heat into the heater underlayers and/or overcoats, the total required input energy to the heater can be reduced while still transferring the same amount of energy to the ink. For an intrinsic 1800 dpi heater array, heater pitch is ~14 μm. However, most heater designs require ~10 μm heater width, which makes it difficult to form flow features and chamber walls. Also as in previous ultra-low energy heater stack designs, a thin overcoat is a common requirement. However, reliability is a huge concern for such designs, since water hammer and cavitation forces could easily damage such thin layer(s).

Thus, there is a need for an innovation that will improve heater ejector efficiency, increase heater density, reduce inkjet drop size, shrink heater chip size and eliminate heater dimension as a limiting factor.

SUMMARY OF THE INVENTION

Various embodiments of the present invention address some or all of the foregoing needs by providing an innovation that moves from a substantially planar heater stack to a vertical fin-shaped heater stack. (A definition of fin-shaped as used herein is having the shape of a projecting, approximately flat, plate or structure.) This eliminates the heater dimension as a constraint factor enabling a high density heater array, greatly reduces the water hammer effect during ink refill, and greatly reduces cavitation force due to bubble collapse. In some embodiments, water hammer and cavitation forces on the heater stack surface are reduced due to the fact that the heater stack surface is disposed parallel to ink flow and jetting direction. All of these will result in significantly increased heater stack reliability. With the vertical fin-shaped heater stack, the area of underlying silicon substrate is also reduced and ink bubbles can form on both sides of the heater stack with minimum thermal loss to the surrounding substrate, which results in marked improvement of ejector efficiency.

Accordingly, in an aspect of the present invention, a fin-shaped heater stack includes first strata configured to support and form fluid heater elements responsive to repetitive electrical activation and deactivation to produce repetitive cycles of ejection of a fluid, and second strata on the first strata to protect the fluid heater elements from adverse effects of the repetitive cycles of fluid ejection and of contact with the fluid. The first strata includes a substrate having a front surface, and a heater substrata supported on the front surface having a pair of opposite facing side surfaces extending approximately perpendicular to the front surface and an end surface interconnecting the side surfaces extending approximately parallel to the front surface such that the heater substrata is provided in a fin-shaped configuration on the substrate with the fluid heater elements forming the opposite facing side surfaces of the heater substrata.

In another aspect of the present invention, a method for forming a fin-shaped heater stack includes processing one sequence of materials to produce a first strata having a substrate and heater substrata supported on a front surface of the substrate with a pair of side surfaces oppositely facing from one another and extending approximately perpendicular to the front surface and an end surface interconnecting the side surfaces and extending approximately parallel to the front surface such that the heater substrata is provided in a fin-shaped configuration on the substrate having fluid heater elements forming the opposite facing side surfaces and being responsive to repetitive electrical activation and deactivation to produce repetitive cycles of ejection of a fluid, and processing another sequence of materials to produce a second strata on first strata to protect the fluid heater elements from adverse effects of the repetitive cycles of fluid ejection and of contact with the fluid.

BRIEF DESCRIPTION OF THE DRAWINGS

Figure 1:
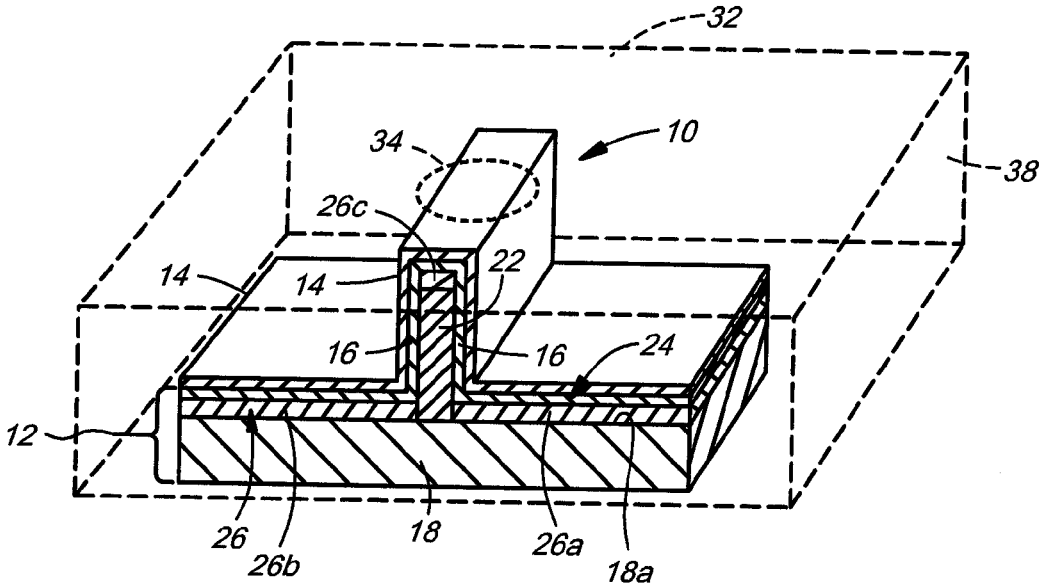

Having thus described the invention in general terms, reference will now be made to the accompanying drawings, which are not necessarily drawn to scale and in some instances portions may be exaggerated in order to emphasize features of the invention, and wherein:

FIG. 1 is a perspective view of a schematic representation of an exemplary embodiment of an upright fin-shaped heater stack of the present invention.

Figure 2:
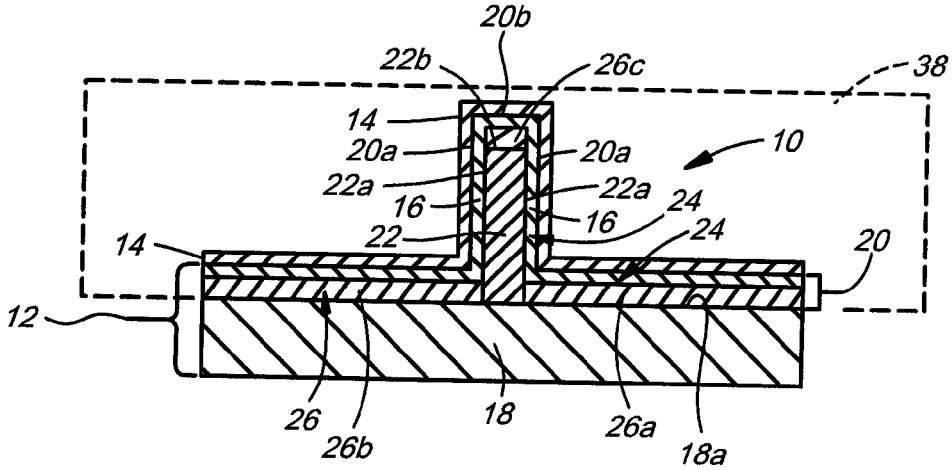

FIG. 2 is a sectional view of the schematic representation of the upright fin-shaped heater stack of FIG. 1.

Figure 3:
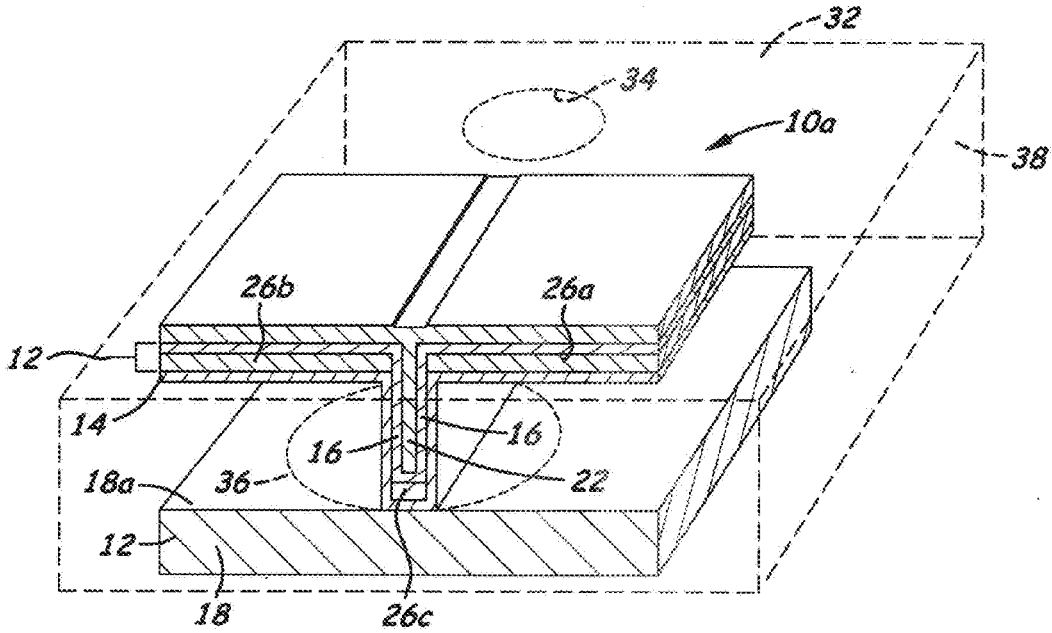

FIG. 3 is a perspective view of a schematic representation of an exemplary embodiment of an inverted fin-shaped heater stack of the present invention.

Figure 4:
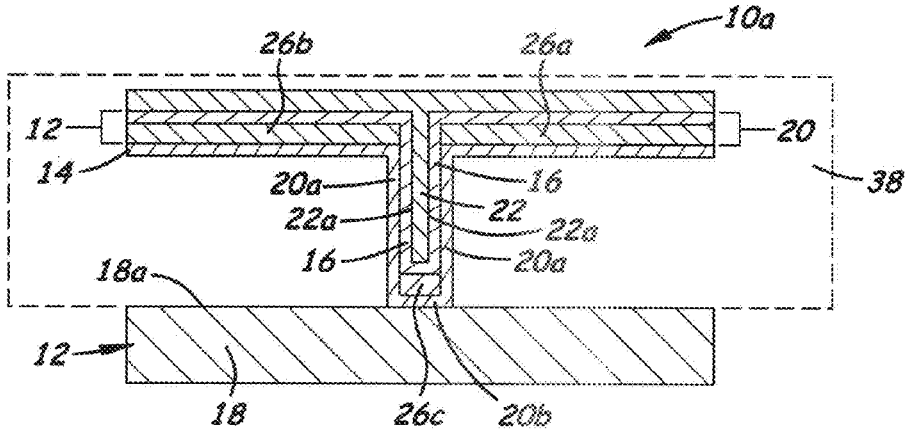

FIG. 4 is a sectional view of the schematic representation of the inverted fin-shaped heater stack of FIG. 3.

FIGS. 5 and 6-10 depict a succession of stages in forming the upright fin-shaped heater stack of FIGS. 1 and 2 in accordance with the method of the present invention.

FIGS. 5 and 11-15 depict a succession of stages in forming the inverted fin-shaped heater stack of FIGS. 3 and 4 in accordance with the method of the present invention.

DETAILED DESCRIPTION

The present invention now will be described more fully hereinafter with reference to the accompanying drawings, in which some, but not all embodiments of the invention are shown. Indeed, the invention may be embodied in many different forms and should not be construed as limited to the embodiments set forth herein; rather, these embodiments are provided so that this disclosure will satisfy applicable legal requirements. Like numerals refer to like elements throughout the views.

Referring now to FIGS. 1-4, there are illustrated exemplary embodiments of a vertical fin-shaped heater stack, generally designated 10 and 10*a*. FIGS. 1 and 2 illustrate the upright vertical configuration of the fin-shaped heater stack 10. FIGS. 3 and 4 illustrate the inverted vertical configuration of the fin-shaped heater stack 10*a*. Each of the upright and inverted vertical configurations of the heater stacks 10 and 10*a* includes first and second strata 12, 14. The first strata 12 of both heater stacks 10, 10*a* are configured to support and form fluid heater elements 16 in substantially vertical orientations and responsive to repetitive electrical activation and deactivation to produce repetitive cycles of ejection of a fluid. The second strata 14 of both heater stacks 10, 10*a* are deposited on the first strata 12 to protect the fluid heater elements 16 from the adverse effects of the repetitive cycles of fluid ejection and of contact with the fluid.

The first strata 12 include a substrate 18 having a front surface 18*a*, and heater substrata 20 supported on the front surface 18*a*. The heater substrata 20 have opposite facing side surfaces 20*a* which extend approximately (about or more or less) perpendicular to the front surface 18*a* and an end surface 20*b* interconnecting the side surfaces 20*a* which extends approximately (about or more or less) parallel to the front surface 18*a* such that the heater substrata 20 is provided in either the upright fin-shaped configuration of FIGS. 1 and 2 or the inverted fin-shaped configuration of FIGS. 3 and 4 on the substrate 18 with the fluid heater elements 16 forming the opposite facing side surfaces 20*a* of the heater substrata 20. The fluid heater elements 16 of the heater substrata 20 are spaced apart with a column 22 of a suitable non-conductive material disposed between the fluid heater elements 16 filling the space between them. Preferably, the substrate 18 is made from silicon and the column 22 is made from one of silicon, a polymer or a dielectric material. The column 22 and thus the fluid heater elements 16 extend to a height above the front surface 18*a* of the substrate 18 that is substantially greater than the distance between the side surfaces 20*a* and thus between the heater elements 16, which accounts for the respective upright and inverted fin-shaped configurations of the heater stacks 10, 10*a*.

As seen in FIGS. 1 and 2, the heater substrata 20 ofhe heater stack 10 have resistive and conductive layers 24, 26 provided togetherin the upright fin-shaped configuration on the front surface 18*a* of the substrate 18 in which portions of the resistive layer 24 overlie the conductive layer 26, and the second strata 14 overlies the resistive layer 24. The conductive layer 26 has anode and cathode portions 26*a*, 26*b* separated from one another, overlying the front surface 18*a* of the substrate 18, and connected with the portions of the resistive layer 24 defining the fluid heater elements 16 at the opposite side surfaces 20*a* of the heater substrata 20. The conductive layer 26 also has an intermediate portion 26*c* disposed between and spaced from the anode and cathode portions 26*a*, 26*b* at the end surface 20*b* of the heater substrata 20 and connected with the fluid heater elements 16 so as to define an electrical short circuit between the fluid heater elements 16 to prevent bubble nucleation on top of the fin structure. The intermediate portion 26*c* of the conductive layer 26 is spaced above the front surface 18*a* of the substrate 18 the height of the column 22. The anode, cathode and intermediate portions 26*a*-26*c* of the conductive layer 26 all have a thickness greater than the thickness of the fluid heater elements 16.

As seen in FIGS. 3 and 4, the heater substrata 20 of the heater stack 10*a* likewise have resistive and conductive layers 24, 26. They are now provided together in an inverted fin-shaped configuration on the front surface 18*a* of the substrate 18 in which portions of the resistive layer 24 overlie the portions of the conductive layer 26, and the second strata 14 underlies the conductive layer 26. The conductive layer 26 has the anode and cathode portions 26*a*, 26*b* separated from one another, spaced from the front surface 18*a* of the substrate 18 by the height of the vertical heater elements 16, and located adjacent to the opposite side surfaces 20*a* of the heater substrata 20 so that they connect with the fluid heater elements 16 at the side surfaces 20*a*. The conductive layer 26 also has the intermediate portion 26*c* disposed between and spaced below from the anode and cathode portions 24, 26 at the end surface 20*b* of the heater substrata 20. The intermediate portion 26*c* is connected with the fluid heater elements 16 so as to define the electrical short circuit between the fluid heater elements 16. The intermediate portion 26*c* of the conductive layer 26 is spaced above the front surface 18*a* of the substrate 18 by the thickness of the second strata 14. The column 22 of non-conductive material is disposed between the fluid heater elements 16 of the heater substrata 20 filling the space between them. Likewise, the substrate 18 is made from silicon and the column 22 is made from one of silicon, a polymer or a dielectric material. The column 22 and thus the fluid heater elements 16 extend to a height above the front surface 18*a* of the substrate 18 that is substantially greater than the distance between the side surfaces 20*a* and thus the heater elements 16.

Turning now to FIGS. 5-15, there are illustrated successions of stages in forming the upright and inverted vertical fin-shaped heater stacks 10, 10*a* of FIGS. 1-4 in accordance with the method of the present invention. Both successions of stages involve, first, processing one sequence of materials to produce the first strata 12 having the substrate 18 and the heater substrata 20 supported on the front surface 18*a* of the substrate 18, and, second, processing another sequence of materials to produce the second strata 14 on first strata 12 to protect the fluid heater elements 16 from adverse effects of the repetitive cycles of fluid ejection and of contact with the fluid. The first strata 12 so produced has the side surfaces 20*a* oppositely facing from one another and extending approximately perpendicular to the front surface 18*a* and the end surface 20*b* interconnecting the side surfaces 20*a* and extending approximately parallel to the front surface 18*a*. The heater substrata 20 is thus provided in each of the upright and inverted vertical fin-shaped configurations on the substrate 18 with fluid heater elements 16 extending vertically and forming the opposite facing side surfaces 20*a* and being responsive to repetitive electrical activation and deactivation to produce repetitive cycles of ejection of a fluid.

Figure 5:
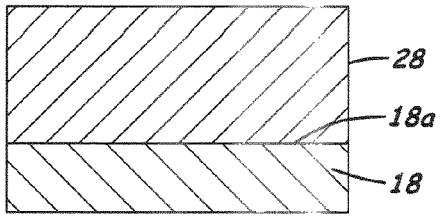

More particularly, as seen in FIG. 5, processing the one sequence of materials includes depositing a thick sacrificial layer 28, such as of silicon oxide, on the front surface 18*a* of the wafer or substrate 18. It is assumed that the basic chip and its power FET (field effect transistor) and control circuitry have already been fabricated on the wafer or substrate 18. This deposition may be as a spin-on coating, using PVD (physical vapor deposition) or CVD (chemical vapor deposition) processes, and the thickness would normally be between 5 μm to 10 μm, which will define the ultimate height of the heater stacks 10, 10*a*. The thick silicon oxide layer 28 also may be replaced by other materials, such as a suitable polymer, silicon or other dielectric materials.

Figure 11:
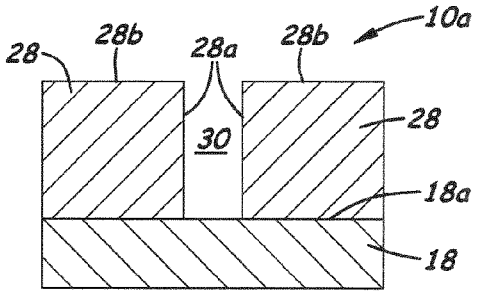
Figure 6:
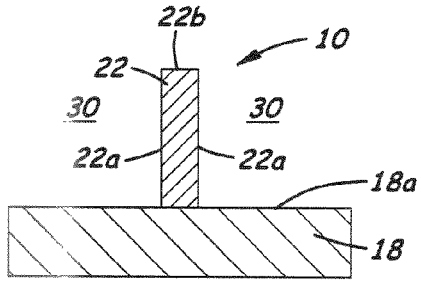

After completing the deposition of the sacrificial layer 28 of thick silicon dioxide, processing the one sequence of material also includes using a DRIE (deep reactive ion etch) process to etch the layer 28 approximately perpendicular to the front surface 18*a* of the substrate 18, as seen in FIGS. 6 and 11. With respect to the formation of the upright fin-shaped heater stack 10, as seen in FIG. 6, the etching forms trenches 30 having widths extending parallel to the front surface 18*a* of the substrate 18 that are substantially greater than the distance between them or the width of the column 22 of the layer 28 that is left standing upright on the front surface 18*a* of the substrate 18. With respect to the formation of the inverted fin-shaped heater stack 10*a*, as seen in FIG. 11, the etching forms a trench 30 having a width extending approximately parallel to the front surface 18*a* of the substrate 18 which is substantially less than the widths of the sacrificial columns 28 extending approximately parallel to the front surface 18*a* of the substrate 18. The width of the column 22 in FIG. 6 or the width of the trench 30 in FIG. 11 which will basically define the widths of the fin-shaped heater stacks 10, 10*a* should be less than 0.5 μm, otherwise, heater stack efficiency could be impacted due to extensive heat loss due to the thermal mass of the fin structure material.

Figure 7:
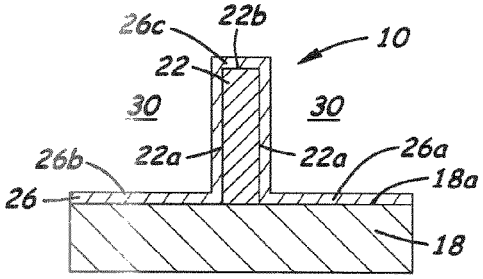
Figure 8:
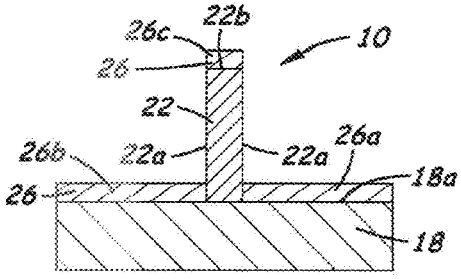

Next, with respect to the upright fin-shaped heater stack 10, as seen in FIG. 7, processing the one sequence of material further includes depositing the conductive layer 26 on the front surface 18*a* of the substrate 18 adjacent opposite side surfaces 22*a* of the column 22 and on an end surface 22*b* of the column 22. This provides anode and cathode portions 26*a*, 26*b* of the conductive layer 26 overlying the front surface 18*a* of the substrate 26 at the bottoms of the trenches 30 adjacent to the opposite side surfaces 22*a* of the column 22 and an intermediate portion 26*c* of the conductive layer 26 overlying the end surface 22*b* of the column 22. The conductive layer such as an Al film may be deposited using a sputtering process. Due to the nature of the sputtering process, the Al film will be thick on planar surfaces such as the front surface 18*a* of the substrate 18 and the end surface 22*b* of the column 22, but very thin at both side surfaces 22*a* of the fin structure or column 22. The Al film on the top end surface 22*b* of the column 22 is provided to electrically short the resistive film at that area so that nucleation will only happen at the side surfaces or at the heater elements 16 thereon. Following next, as seen in FIG. 8 after the conductive layer 26 or Al deposition, an isotropic etch (wet or dry etch) of the conductive layer 26 is conducted to clean up the thin Al film on the side surfaces 22*a* of the column 22. This etch process is tuned so that Al on the side surfaces 22*a* will be cleaned up, while preserving Al on the top end surface 22*b* and on the base (of the fin structure) or front surfaces 18*a* of the substrate 18.

Figure 12:
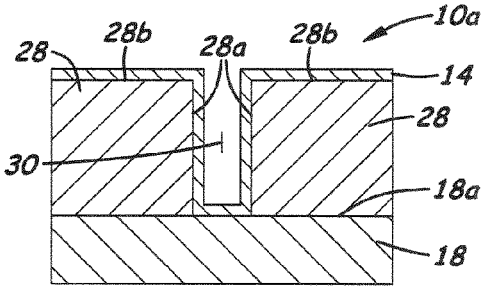
Figure 13:
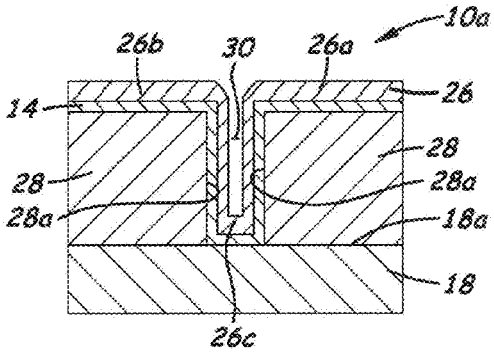
Figure 14:
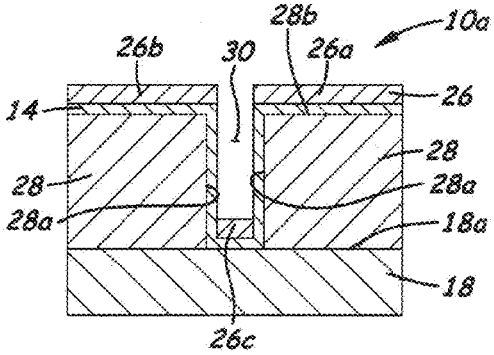

With respect to the inverted fin-shaped heater stack 10*a*, as seen in FIGS. 12 and 13, processing the other sequence of material further includes depositing the protective layer or second strata 14 on the front surfaces 28*a* of the sacrificial columns 28 and the front surface 18*a* of the substrate 18 at the bottom of the trench 30 and also on the adjacent opposite side surfaces 28*a* of the columns 28 therebetween. The protective layer or second strata 14 may be composed of Ta/SiN, $Ta_2O_5$, SiN, $SiO_2$, SiC or AlN films or the like. Then, in processing the one sequence of material, the conductive layer 26 of the first strata 12 is deposited over the protective layer or second strata 14. The same deposition and etch clean-up processes, as seen in FIGS. 13 and 14, are used here as previously described with respect to FIGS. 7 and 8. This provides anode and cathode portions 26*a*, 26*b* of the conductive layer 26 overlying the front surfaces 28*a* of the sacrificial columns 28 adjacent to the opposite side surfaces 28*a* of the columns 28 and an intermediate portion 26*c* of the conductive layer 26 overlying the front surface 18*a* of the substrate 18 at the bottom of the trench 30.

Figure 9:
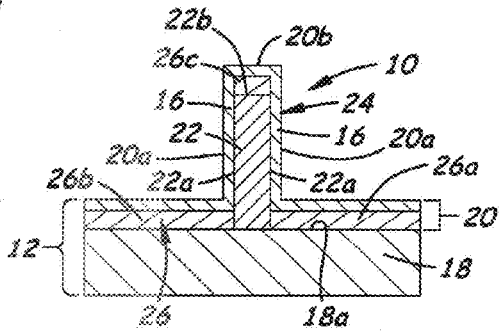
Figure 15:
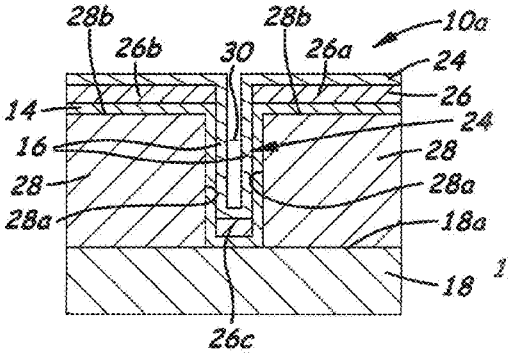
Figure 10:
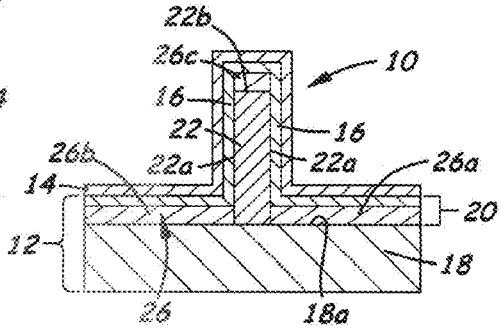

With respect to both the upright and inverted fin-shaped heater stacks 10, 10*a*, as seen in FIGS. 9 and 15, processing the one sequence of material includes depositing the resistive layer 24 such that portions of the resistive layer 24 overlie the anode, cathode and intermediate portions 26*a*-26*c* of the conductive layer 26 and the opposite side surfaces 22*a*, 28*a* of the column(s) 22, 28 so as to form the electrical heater elements 16 on the side surfaces 22*a*, 28*a* of the column(s) 22, 28 and the electrical short circuit between the heater elements 16 through the intermediate portion 26*c* of the conductive layer 26 on the end surface 22*b* of the column 22 and underlying a portion of the resistive layer 24. The resistive layer 24 or film may be composed of TaN, TaAlN, TaAl, SiCrC, or the like. An atomic layer deposition (ALD) process may be used for this step. Then, as seen in FIG. 10, the protective layer or second strata 14 is deposited on the resistive layer 24 with respect to the upright fin-shaped heater stack 10. The protective layer or second strata 14 may be composed of Ta/SiN, $Ta_2O_5$, SiN, $SiO_2$, SiC or AlN films. This completes the formation of the upright fin-shaped heater stack 10, as seen in FIGS. 1, 2 and 10. In FIG. 15 the sacrificial column 28 is removed to form the final structure seen in FIG. 3.

As seen in FIGS. 3 and 4, a layer 22 is deposited on the resistive layer 24 to complete the inverted fin-shaped heater stack 10*a*. Other steps are envisioned to further adapt the heater stacks 10, 10*a* for application, such as to make electrical connection from heater to base chip circuit, a contact mask step may also be included in the process flow. Also, formation of nozzle plates 32 and holes 34, ink flow channels 36 from the backside of the substrate, and ink chambers 38 can be undertaken. Also, it should be understood that this process can be used to form entire heater arrays for single or multiple vias. However, since these do not form a part of the present invention, they need not be described in further detail herein. Also, in FIGS. 1 and 3 the edges of the fins are exposed. However, this is only for purpose of illustration of the different layers. One skilled in the art would recognize that the layers must step down to form a seal so the conductive layers are not corroded by the fluid or that a final PO (protective overcoat) would be added.

The foregoing description of several embodiments of the invention has been presented for purposes of illustration. It is not intended to be exhaustive or to limit the invention to the precise forms disclosed, and obviously many modifications and variations are possible in light of the above teaching. It is intended that the scope of the invention be defined by the claims appended hereto.

What is claimed is:

1. A fin-shaped heater stack, comprising:

first strata configured to support and form fluid heater elements responsive to repetitive electrical activation and deactivation to produce repetitive cycles of ejection of a fluid, said first strata including:

a substrate having a front surface, and a heater substrata supported on said front surface having a pair of opposite facing side surfaces extending perpendicular to said front surface and an end surface interconnecting said side surfaces extending parallel to said front surface such that said heater substrata is provided in a fin-shaped configuration on said substrate with said fluid heater elements forming said opposite facing side surfaces of said heater substrata; and second strata on said first strata to protect said fluid heater elements from adverse effects of said repetitive cycles of fluid ejection and of contact with the fluid.

2. The stack of claim 1 wherein said opposite side surfaces of said heater substrata are spaced apart and extend to a height above said front surface of said substrate that is greater than the distance between said side surfaces.

3. The stack of claim 1 wherein said heater substrata have resistive and conductive layers provided together in an upright fin-shaped configuration on said front surface of said substrate in which portions of said resistive layer overlie said conductive layer and said second strata overlies said resistive layer.

4. The stack of claim 1 wherein said heater substrata have resistive and conductive layers provided together in an inverted fin-shaped configuration on said front surface of said substrate in which portions of said resistive layer underlie said conductive layer portions and said second strata underlies said resistive layer.

5. The stack of claim 3 wherein said conductive layer has anode and cathode portions separated from one another, overlying said front surface of said substrate, and connected with said fluid heater elements at said opposite side surfaces of said heater substrata.

6. The stack of claim 4 wherein said conductive layer has anode and cathode portions separated from one another, spaced from said front surface of said substrate, adjacent to said opposite side surfaces of said heater substrata, and connected with said fluid heater elements at said side surfaces of said heater substrata.

7. The stack of claim 5 wherein said conductive layer also has an intermediate portion disposed between and spaced from said anode and cathode portions at said end surface of said heater substrata and connected with said fluid heater elements so as to define an electrical short circuit between said fluid heater elements.

8. The stack of claim 6 wherein said conductive layer also has an intermediate portion disposed between and spaced from said anode and cathode portions at said end surface of said heater substrata and connected with said fluid heater elements so as to define an electrical short circuit between said fluid heater elements.

9. The stack of claim 7 wherein said anode, cathode and intermediate portions of said conductive layer have a thickness greater than a thickness of said fluid heater elements.

10. The stack of claim 7 wherein said intermediate portion of said conductive layer is spaced above said front surface of said substrate, and acolumn of non-conductive material is disposed between said fluid heater elements of said heater substrata filling the space between said fluid heater elements.

11. The stack of claim 8 wherein substrate is made from silicon and said column is made from one of silicon, a polymer or a dielectric material.

12. The stack of claim 8 wherein said intermediate portion of said conductive layer is on said front surface of said substrate and a column of non-conductive material is disposed between said fluid heater elements of said heater substrata filling the space between said fluid heater elements.

13. The stack of claim 10 wherein said substrate is made from silicon and said column is made from one of silicon, a polymer or a dielectric material.

14. The stack of claim 12 wherein said substrate is made from silicon and said column is made from one of silicon, a polymer or a dielectric material.

* * * * *